United States Patent [19]
Braun
[11] 4,242,807
[45] Jan. 6, 1981

[54] PAINT LINE FLOTATION OVEN

[75] Inventor: Curt Braun, Riverside, Calif.
[73] Assignee: Hunter Engineering Co., Inc., Riverside, Calif.

[21] Appl. No.: 932,801
[22] Filed: Aug. 11, 1978
[51] Int. Cl.[3] ..... F26B 3/10
[52] U.S. Cl. ..... 34/23; 34/43; 34/155; 34/156; 118/672; 118/68; 226/97; 34/222; 34/229
[58] Field of Search ..... 34/156, 155, 210, 215, 34/216, 217, 222, 229, 23, 34, 43, 52, 54, 157; 226/97; 427/444; 118/6, 58, 68; 432/8, 58

[56] References Cited

U.S. PATENT DOCUMENTS

| | | | |
|---|---|---|---|
| 3,033,539 | 5/1962 | Cook et al. | 257/306 |
| 3,198,499 | 8/1965 | Stanley | 432/58 |
| 3,234,662 | 2/1966 | Alexeff et al. | 34/54 |
| 3,262,688 | 7/1966 | Beggs | 266/2 |
| 3,367,039 | 2/1968 | Jacobsen | 34/157 |
| 3,668,788 | 6/1972 | Kobayashi | 34/156 |

OTHER PUBLICATIONS

"Lay On Air"-Ovens & Dryers for Aluminum Foil Strip-Vits-date unknown.
Catenary Systems Automated Sheet Tension Controls--Drexelbrook Engrg. Company-date unknown.

*Primary Examiner*—Larry I. Schwartz
*Attorney, Agent, or Firm*—Robert T. Tobin

[57] ABSTRACT

Heat treating apparatus for continuous painted strip, comprising an elongated, convective heating oven through which painted strip is passed while jets of hot gas are directed against the top and bottom surfaces of the strip to dry and cure the paint film. The strip is suspended from tension bridles at opposite ends of the oven, and hangs in a relatively flat catenary curve therefrom. Spaced longitudinally within the oven is a plurality of pairs of headers which are arranged to follow the catenary curve of the strip, each of said pairs comprising an upper header located above the strip and a lower header located below the strip. Each of the headers has a plurality of jet nozzles directed toward the strip, and duct means is provided for supplying hot gas to the headers so that the nozzles send jets of hot gas impinging against the strip. The static and dynamic pressure of the jets of hot gas cause the strip to float while still following the catenary curve that the strip takes when merely hanging by gravity from the bridles. However, when the strip is floated by the hot gas jets, all or most of the weight of the strip is carried by the gas, and tension in the strip is correspondingly reduced. Each of the headers is adjustable vertically so that it can be positioned to closely approximate the catenary curve of the strip, and also so that it can be moved closer to or further away from the strip so as to increase or decrease the amount of flotation.

6 Claims, 3 Drawing Figures

PAINT LINE FLOTATION OVEN

BACKGROUND OF THE INVENTION

The present invention pertains to apparatus for heat treating metal strip by convection heat transfer, particularly for curing and drying paint film applied to one or both sides of the strip.

In the coil coating industry, it has long been the practice to pass the painted strip through elongated horizontal ovens, in which the strip hangs in a relatively flat catenary curve from rollers set at the entrance and exit ends of the oven. Since the ovens are from approximatey 50 to 100 meters or more long, it is necessary to maintain considerable tension on the strip in order to keep the total sag within acceptable limits. With wide strip and in heavier gauges, the tension becomes quite large, and requires extremely heavy machinery and powerful drive motors to handle the load, which has the effect of making the machinery extremely expensive. Another serious problem is that in some cases the specific tension on the strip may become critical and/or excessive.

To avoid some of the difficulties and objections inherent in the above-described system, another form of strip transport has been devised, using jets of air impinging against the bottom and top surfaces of the strip to "float" the strip through the oven. This type of arrangement has many advantages, but there are times when the high velocity jets of air are detrimental, as when a wet paint film of low viscosity is being cured, in which case the jets of air may cause the paint to flow before it has taken its initial set.

In a production paint line which may coat strip of various gauges with many different kinds of paint having different characteristics, it will be found that there are some situations where the suspension oven with the strip hanging in a catenary curve is the best choice, whereas in other situations the flotation oven in which the strip is supported wholly or in part by air jets is the better choice. In still other situations, it may be desirable to have the strip hang in a catenary curve for a portion of the length of its transit through the oven, and then to be floated on air jets for another portion of the length of travel. With prior paint line ovens, this is not possible, as the oven is either a catenary curve oven or a floatation oven.

SUMMARY OF THE INVENTION

The primary object of the present invention is to provide a new and improved paint line oven that combines the best features of both the catenary oven and the flotation oven. More specifically, the present invention provides a paint line oven in which the strip hangs in a catenary, or close approximation to a catenary curve, and in which jets of heated air impinging against the top and bottom surfaces of the strip float the strip so that all or any desired part of the weight of the strip is supported by air pressure.

Another important object of the invention is to provide a paint line oven wherein the strip is suspended from tension bridles at the entrance and exit ends of the oven and hangs in a relatively flat catenary curve, and in which a plurality of headers are arranged along the length of the strip above and below the strip, each header having a plurality of air jet nozzles directed against the adjacent surface of the strip, and each header, or a limited number of them, being adjustable so that the headers can closely follow the catenary curve of the strip. Thus, when the hot air jets are turned on, the strip may be floated to any desired extent by moving the headers closer to or further away from the strip, while the strip remains approximately in the catenary curve taken while the strip was hanging by gravity. The same effect of partial or full flotation of the strip may be obtained by increasing or decreasing the air pressure while maintaining the headers in a fixed position, which causes the velocity of the air jets to be correspondingly increased or decreased.

A paint line oven in accordance with the present invention has great flexibility, and is capable of handling aluminum or steel strip in a wide range of metal gauges, and different types of paint with widely varying viscosities. At the same time, the construction is simple and inexpensive, compared to conventional ovens capable of handling the same range of metal strip and paints.

These and other objects and advantages of the invention will become apparent to those skilled in the art from the following detailed description of the preferred embodiment thereof, with reference to the accompanying drawings.

Figure 2:
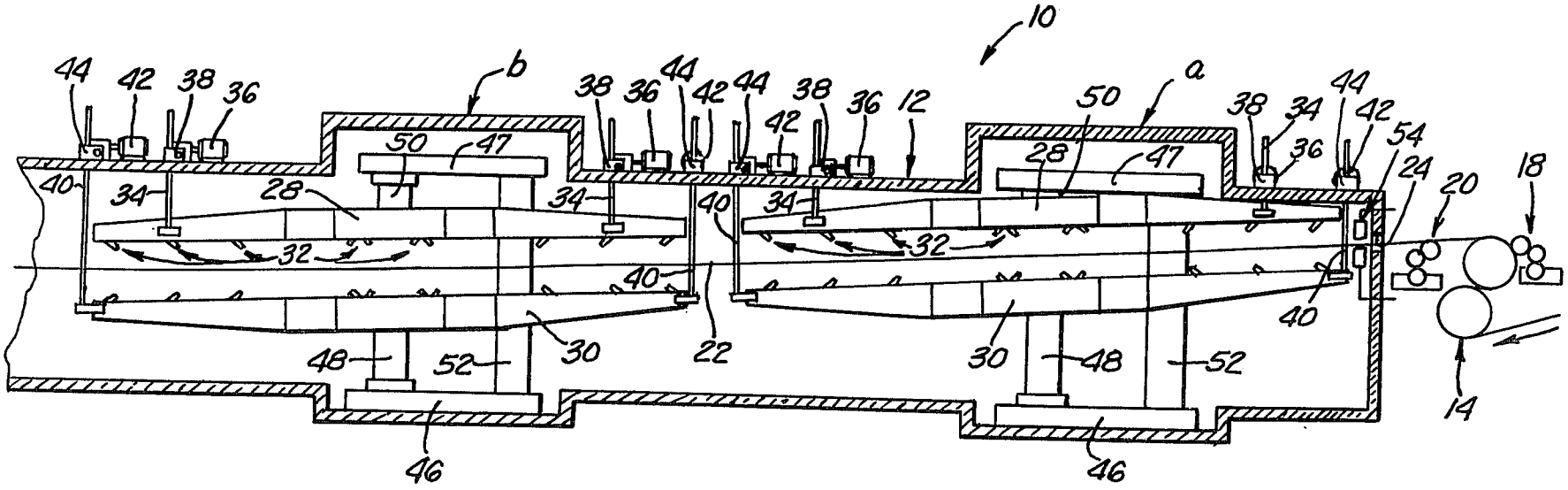
FIG. 2 is an enlarged view of the entrance end of the apparatus shown in FIG. 1.

DESCRIPTION OF THE PREFERRED EMBODIMENT:

In the drawings, the paint line system of the invention is designated in its entirety by the reference numeral 10 and comprises an elongated oven 12, with tension bridles 14 and 16 at the entrance and exit ends, respectively, and paint rollers 18 and 20 at the entrance end of the oven, for applying paint to the top and bottom surfaces, respectively, of the continuous strip 22. Strip 22 is usually aluminum or steel, although it may be any metal, and may be in any width and any guage.

Figure 1:
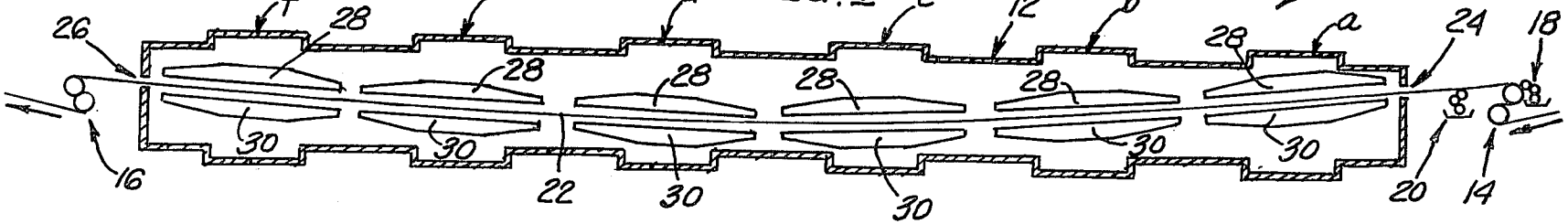
FIG. 1 is a diagrammatic representation of a continuous strip paint line embodying the invention.
Figure 3:
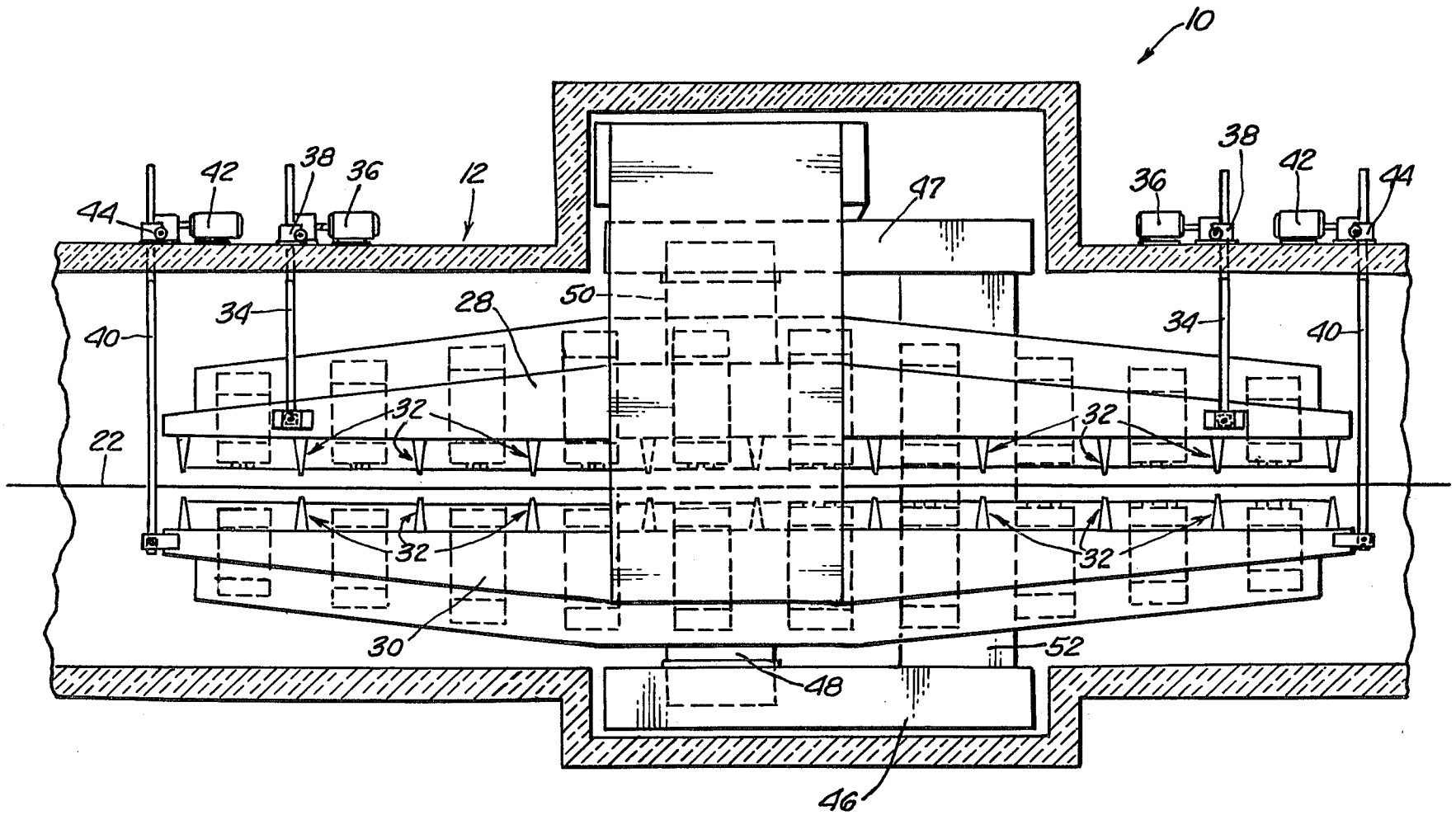
FIG. 3 is a further enlarged view of one bay in the apparatus.

The tension bridles 14 and 16 are driven by motors (not shown) and are synchronized to exert tension on the strip 22 during its passage through the oven 12. As best shown in FIG. 1, the strip 22 normally hangs by gravity in a relatively flat catenary curve between the bridles 14, 16. The amount of sag in the strip (when unsupported by air, as will be explained presently) depends upon the tension in the strip, which is controlled by the bridles. The strip 22 enters the oven 12 through an entrance slit 24 in the right-hand end of the oven as seen in FIGS. 1 and 2, and exits through an exit slit 26 in the left-hand end of the oven as in FIG. 1.

The oven 12 is typically from thirty to seventy meters long, and is made up of a number of heating zones, or bays, here shown for convenience as six, designated a, b, c, d, e and f, which are substantially identical to one another. Disposed within each of the bays is an upper header 28 and a lower header 30, which are respectively arranged above and below the strip 22, extending generally parallel to the strip. Each of the headers 28, 30 has a plurality of longitudinally spaced air jet nozzles 32 that are directed toward the adjacent surface of the strip. The nozzles 32 extend transversely across the width of the strip 22, and may direct their air jet perpendicularly against the strip or at an angle to the longitudinal axis of the strip.

A suitable means is also provided to adjust each header 28, 30 relative to the catenary path. For example, the upper headers 28 are adjustably supported by screw jacks 34, which pass through openings in the roof of the oven 12, and are driven by motors 36 through gears 38. Lower headers 30 are also adjustably supported by screw jacks 40, which pass through openings in the roof of the oven and are driven by motors 42 through gears 44. It is to be understood, however, that each of the headers 28, 30 may be adjusted vertically by any of various other means, and the screw jacks 34 are only shown as an example of the means for adjusting the headers.

The purpose of the headers with their respective air jet nozzles is to direct jets of heated air or combustion gases against the wet surfaces of the paint applied by rollers 18 and 20, so as to evaporate any solvents in the paint film and/or cure the paint. Hot gas is supplied to the headers from an incinerator, or combustion chamber (not shown) through manifolds 46, 47 and telescoping ducts 48 and 50. The upper manifold 47 is supplied from the lower manifold 46 by a connection duct 52. After the hot gas has impinged against the paint film on the strip, it is exhausted from the oven by blowers (not shown) and is recirculated through the incinerator or combustion chamber.

One of the novel features of the present invention resides in the arrangement of the headers 28, 30 so that they can accurately follow a catenary curve, or close approximation to a catenary curve, that the strip 22 might take when hanging by gravity from the bridle rolls 14, 16 without any support from the air jet nozzles. The headers 28, 30 can be raised or lowered so as to decrease or increase the distance of the air jet nozzles 32 from the strip, and thereby increase or decrease the amount of flotation, or the headers can be tilted to a greater or lesser angle from the horizontal by raising or lowering the ends by different amounts. The amount of flotation of the strip can also be varied by changing the air pressure in one or more sections, or by combinations of air-pressure change and vertical adjustment of the headers.

When the hot air or combustion gas is directed by the nozzles 32 against the top and bottom surfaces of the strip, any desired amount of flotation can be obtained by differentially varying the distance of the nozzles 32 of the upper header 28 and lower header 30 from the strip, or by varying the velocity of hot gas issuing from the nozzles. By increasing the amount of flotation until the entire weight of the strip is supported by the static and/or dynamic pressures of the air jets, the effect of gravity may be completely eliminated, which means that the strip would continue to remain in a catenary curve but without any tension on the strip.

In order to control the location of the headers 28, 30, and their respective jet nozzles 32, or the air pressure, or both, a control sensor 54 is positioned at one end of the oven 12 to sense the angle of the strip 22 in the catenary. The sensor 54 is shown only schematically, and includes a proximity switch and responsive circuitry such as an automated sheet tension control, Model 508-1 Series Catenary Control System, manufactured by the Drexelbrook Engineering Co. These sensors utilize a proximity (non-contacting) probe which produces a continuous electrical output signal proportional to the deviation (droop or sag) of the strip 22 from the predetermined catenary curve. This signal is then used to vary the position of the headers, the jet nozzles, or both, or the air pressure on the strip 22. By varying one or more of these parameters the strip 22 can be maintained in the desired catenary or flotation mode, or combination thereof.

Under some conditions it may be desirable to have differential flotation in different parts of the oven. This is easily accomplished by merely moving the headers further away from the strip at one part of the oven, while bringing the headers in closer to the strip in another part. An example of the type of condition requiring this type of differential flotation would be where a low-viscosity paint had been applled to the strip, which cannot tolerate the impingement of a high velocity jet until the paint has begun to set up. In this case, the headers would be removed a substantial distance from the strip at the entrance end of the oven to reduce the velocity of the jets of hot gas impinging against the fluid paint and allow the paint to take a set without being blown about. The same effect can be produced by varying the air velocity of the jets issuing from nozzles 32.

By differentially varying the distance of the nozzles 32 of the headers from the strip, or by varying the velocity of hot gas issuing from the nozzles, any desired amount of flotation can be obtained. Thus, by increasing the amount of flotation until the entire weight of the strip is supported by the static and dynamic pressures of the air jets, the effect of gravity may be completely eliminated, which means that the strip would continue to remain in a catenary curve but without any appreciable tension on the strip. By using flotation to support a substantial part of the weight of the strip, it is possible to regulate the bridles 14, 16 so as to increase tension in the strip and thereby greatly reduce the amount of sag in the catenary, which leads to substantial savings in equipment and furnace cost.

While the nozzles 32 of the upper and lower headers are shown in the drawings as being directly opposed, it is contemplated that the nozzles of one header might be staggered with respect to the nozzles of the other header. This would cause the strip to take a sinuous form as it is first pushed upward, unopposed, by one jet, and then downward, unopposed, by another jet, while the strip remains in the approximate catenary curve from one end to the other of the oven. One advantage of this arrangement is that it eliminates or minimizes the effect of camber on the strip.

The adjusting means for the upper and lower headers might take other forms than the electric-motor-driven screw jacks shown in the drawings. For example, hydraulic or air cylinders could be used instead of screw jacks.

While I have shown and described in considerable detail what I believe to be the preferred form of the invention, it will be understood by those skilled in the art that the invention is not limited by such details, but might take various other forms within the scope of the claims.

What I claim is:

1. A method of curing a film of paint on a travelling stip, said method comprising the steps of:

conveying a travelling strip having a coat of paint thereon through a plurality of heating zones in an oven along a catenary path;

directing jets of gas onto the strip with sufficient velocity and in a direction such as to effect at least partial flotation of the strip;

sensing the angle of the travelling strip at some point along said path; and adjusting the amount of flotation of the strip caused by said gas jets in response to a sensed change in said angle so as to vary tension in the strip in the direction to counteract said change in angle.

2. The method of claim 1 in which said amount of flotation is adjusted by controlling the rate of flow of said gas onto said strip in response to said sensed change in angle.

3. The method of claim 1 in which said amount of flotation is adjusted by controlling the placement of said gas jets relative to said strip.

4. A combination flotation and catenary oven for curing a film of paint on a continuous strip of metal, comprising:

an elongated oven chamber having walls, an entrance opening in one end thereof and an exit opening at the other end through which the strip passes;

support means at opposite ends of said chamber for tensioning said strip and transporting the same through said chamber, said strip normally hanging by gravity in a catenary curve from said support means;

a plurality of headers disposed along the length of the strip within said chamber both above and below the strip, said headers being arranged to follow the catenary curve of the strip;

nozzles on said headers directed toward the adjacent surfaces of the strip;

means supplying hot gas to said headers so that high velocity jets of the gas are discharged through said nozzles against the top and bottom surfaces of the strip, thereby causing at least a portion of the weight of the strip to be floated by the gas;

means for varying the amount of flotation of the strip including means for adjusting the vertical positions of each of said headers so as to vary the distance of the nozzles from the strip so that any desired proportion of the weight of the strip is supported by the hot gas issuing from said nozzles, while the strip remains in a catenary curve or, close approximation thereto, between the support means;

the means for adjusting the position of each of the headers including motors in the outside of said oven chamber, and force-transmitting members passing through said walls of the oven chamber to points of connection with said headers, said force-transmitting members being actuated by said motors to move the headers; and sensor means for detecting any change in the catenary curve of the strip, said sensor means being operable to actuate said motors so as to move said headers toward or away from the strip to increase or decrease the flotation effect and thereby oppose the change in the catenary, as detected by said sensor means.

5. A combination flotation and catenary oven as in claim 4, wherein said means for adjusting the positions of the headers also is adapted to vary the angle of the header with respect to horizontal, so that the header can be tilted to follow the catenary curve of the strip.

6. A coil coating system comprising:

an elongated oven having an entrance end and an exit end;

at least one paint applicator head at said entrance end for applying a coat of paint to a traveling metal strip;

means for passing the coated metal strip through said oven along a catenary path from said entrance end to said exit end;

a plurality of headers within said oven, said headers being disposed above and below said catenary path and including means for directed jets of gas along said path to produce at least partial flotation of a strip traveling on the path;

means for vertically adjusting each header relative to the path so as to position said headers in a curved line closely approximating the catenary path of the strip; and a control sensor at one end of said oven for sensing the angle of the traveling metal strip in said catenary path, said sensor being responsive to changes in said angle to emit a representative signal to said means for adjusting said headers whereby said headers can be adjusted toward or away from the strip so as to increase or decrease the flotation effect on the strip, thereby varying the amount of tension in the strip so as to counteract the change in angle, as detected by said control sensor.

* * * * *